US010395625B2

(12) United States Patent
Yaguchi et al.

(10) Patent No.: US 10,395,625 B2
(45) Date of Patent: Aug. 27, 2019

(54) SUPPORT ASSEMBLY AND KEYBOARD APPARATUS

(71) Applicant: YAMAHA CORPORATION, Hamamatsu-shi (JP)

(72) Inventors: Nariyasu Yaguchi, Hamamatsu (JP); Akito Ohba, Hamamatsu (JP); Hiroshi Harimoto, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 12 days.

(21) Appl. No.: 15/712,273

(22) Filed: Sep. 22, 2017

(65) Prior Publication Data

US 2018/0012574 A1 Jan. 11, 2018

Related U.S. Application Data

(63) Continuation of application No. PCT/JP2016/057126, filed on Mar. 8, 2016.

(30) Foreign Application Priority Data

Mar. 25, 2015 (JP) ..... 2015-063268

(51) Int. Cl.

| | |
|---|---|
| ***G10C 3/168*** | (2019.01) |
| ***G10B 3/12*** | (2006.01) |
| ***G10C 3/16*** | (2019.01) |
| ***G10H 1/34*** | (2006.01) |

(52) U.S. Cl.

CPC ..... *G10C 3/168* (2013.01); *G10B 3/12* (2013.01); *G10C 3/16* (2013.01); *G10H 1/34* (2013.01); *G10H 1/346* (2013.01); *G10H 2220/305* (2013.01)

(58) Field of Classification Search

CPC ..... G10C 3/168; G10C 3/16; G10H 1/346; G10H 1/34; G10H 2220/305; G10B 3/12

See application file for complete search history.

(56) References Cited

U.S. PATENT DOCUMENTS

| | | | |
|---|---|---|---|
| 7,807,907 | B2 | 10/2010 | Inoue |
| 2014/0020543 | A1 | 1/2014 | Oba et al. |

FOREIGN PATENT DOCUMENTS

| | | | | |
|---|---|---|---|---|
| GB | 463714 | A | 4/1937 | |
| GB | 000463714 | A * | 5/1937 | ..... G10C 3/168 |
| JP | 49002327 | U1 | 1/1974 | |
| JP | S5371429 | U | 6/1978 | |
| JP | H0461396 | U | 5/1992 | |
| JP | H0590571 | U | 12/1993 | |

(Continued)

OTHER PUBLICATIONS

Office Action issued in U.S. Appl. No. 15/712,228, dated Jul. 27, 2018.

(Continued)

*Primary Examiner* — Kimberly R Lockett
(74) *Attorney, Agent, or Firm* — Rossi, Kimms & McDowell LLP

(57) ABSTRACT

A support assembly includes a support rotatable with respect to a frame, a repetition lever rotatable with respect to the support, and a first extension portion disposed to the repetition lever on a jack side with respect to the center of rotation of the repetition lever, the first extension portion being in contact with a stopper from below the stopper.

20 Claims, 10 Drawing Sheets

(56) References Cited

FOREIGN PATENT DOCUMENTS

| | | | |
|---|---|---|---|
| JP | 2002202773 | A | 7/2002 |
| JP | 2003228367 | A | 8/2003 |
| JP | 2004252252 | A | 9/2004 |
| JP | 2004280065 | A | 10/2004 |
| JP | 2005292361 | A | 10/2005 |
| JP | 2006171617 | A | 6/2006 |

OTHER PUBLICATIONS

Office Action issued in Japanese Appln. No. 2017-092821 dated Jul. 31, 2018. English translation provided.
Office Action issued in U.S. Appl. No. 15/712,292 dated Sep. 21, 2018.
International Search Report issued in Intl. Appln. No. PCT/JP2016/057125 dated May 24, 2016. English translation provided.
Written Opinion issued in Intl. Appln. No. PCT/JP2016/057125 dated May 24, 2016. English translation provided.
International Preliminary Report on Patentability issued in Intl. Appln. No. PCT/JP2016/057125 dated Sep. 26, 2017. English translation provided.
Copending U.S. Appl. No. 15/712,228, filed Sep. 22, 2017 (a copy is not included because the cited application is not yet available to the public and the Examiner has ready access to the cited application).
Copending U.S. Appl. No. 15/712,292, filed Sep. 22, 2017 (a copy is not included because the cited application is not yet available to the public and the Examiner has ready access to the cited application).
International Search Report issued in Intl. Appln. No. PCT/JP2016/057126 dated May 24, 2016. English translation provided.
Written Opinion issued in Intl. Appln. No. PCT/JP2016/057126 dated May 24, 2016. English translation provided.
International Preliminary Report on Patentability issued in Intl. Appln. No. PCT/JP2016/057126 dated Sep. 26, 2017. English translation provided.
Office Action issued in Japanese Appln. No. 2015-063268 dated Apr. 11, 2017. Partial English translation provided.
International Search Report issued in Intl. Appln. No. PCT/JP2016/057128 dated May 31, 2016. English translation provided.
Written Opinion issued in Intl. Appln. No. PCT/JP2016/057128 dated May 31, 2016. English translation provided.
International Preliminary Report on Patentability issued in Intl. Appln. No. PCT/JP2016/057128 dated Sep. 26, 2017. English translation provided.

* cited by examiner

SUPPORT ASSEMBLY AND KEYBOARD APPARATUS

CROSS-REFERENCE TO RELATED APPLICATIONS

This application is a U.S. continuation application filed under 35 U.S.C. § 111(a), of International Application No. PCT/JP2016/057126, filed on Mar. 8, 2016, which claims priority to Japanese Patent Application No.2015-063268, filed on Mar. 25, 2015, the disclosures of which are incorporated by reference.

FIELD

The present invention relates to a support assembly that is used in a musical keyboard apparatus.

BACKGROUND

Acoustic pianos such as conventional grand pianos and upright pianos are composed of many parts. Further, since the assembly of these parts is of high complexity, the assembling work takes a long time. In particular, the assembly of an action mechanism that is provided in correspondence with each key is of high complexity, as the action mechanism requires many parts.

For example, Japanese Patent Application Laid-Open No. 2005-292361 discloses an action mechanism in which a plurality of parts interact with one another to transmit, to a hammer, the movement of a key being pressed and released. In particular, a part of the action mechanism is constituted by a support assembly that works through a combination of various parts. The support assembly includes not only a mechanism that achieves the striking of the string by the hammer according to the pressing of the key but also an escapement mechanism by which the force to be transmitted to the hammer is released through the movement of the key immediately before the striking of the string. This mechanism is an important mechanism for achieving the basic movements of an acoustic piano. In particular, a conventional grand piano employs a double escapement mechanism including a combination of a repetition lever and a jack.

The movement of the action mechanism gives sensation (hereinafter referred to as "feeling of touch") to the player's finger through the key. In particular, the configuration of the support assembly has an important influence on the feeling of touch. For example, the feeling of touch through the movement of the escapement mechanism is called "let-off".

SUMMARY

A support assembly according to an embodiment of the present invention includes a support rotatable with respect to a frame, a repetition lever rotatable with respect to the support, and a first extension portion disposed to the repetition lever on a jack side with respect to the center of rotation of the repetition lever, the first extension portion being in contact with a stopper from below the stopper.

DESCRIPTION OF EMBODIMENTS

Figure 1:
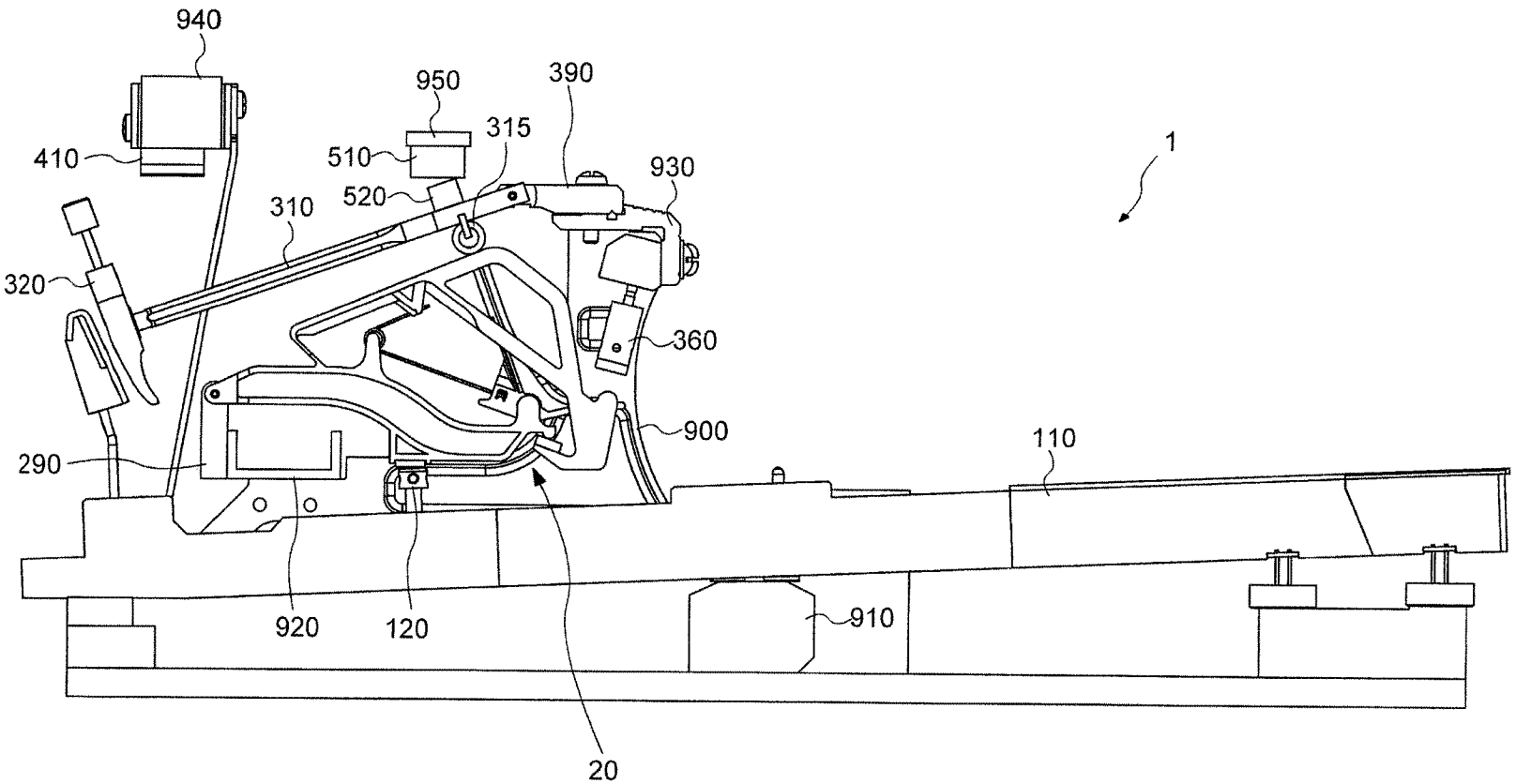
FIG. 1 is a side view showing a configuration of a keyboard apparatus according to an embodiment of the present invention.

A keyboard apparatus including a support assembly according to an embodiment of the present invention is described in detail below with reference to the drawings. The embodiments described below are examples of embodiments of the present invention, and the present invention should not be interpreted within the limits of these embodiments. It should be noted that, in the drawings to which the present embodiment refers, the same components or components having the same functions are given the same reference signs or similar reference signs (signs formed simply by adding A, B, or the like to the end of a number), and a repeated description thereof may be omitted. Further, the dimensional ratios of the drawings (such as the ratio between one component and another and the ratio in length, width, and height directions) may be different from actual ratios for convenience of explanation, and some of the components may be omitted from the drawings.

Since the number of parts that constitute the support assembly is large, the manufacturing lead time is lengthy and the manufacturing cost is high. Therefore, there is a demand for a reduction in manufacturing cost that is achieved simply by reducing the number of parts or simplifying the structure. However, a change in the configuration of the support assembly leads to a great change in the feeling of touch at the time of operation of a key. Therefore, it is difficult to reduce the manufacturing cost of an acoustic piano.

It is an object of the present invention to better suppress a change in the feeling of touch at the time of operation of a key and reduce the manufacturing cost of a support assembly than a keyboard apparatus of an acoustic piano.

<First Embodiment>

[Configuration of Keyboard Apparatus 1]

A keyboard apparatus 1 according to a first embodiment of the present invention is an example in which an example of a support assembly according to the present invention is applied to an electronic piano. In order to, at the time of operation of a key, give a feeling of touch that is similar to that which is given by a grand piano, this electronic piano includes a configuration that is similar to a support assembly of a grand piano. An overview of the keyboard apparatus 1 according to the first embodiment of the present invention is given with reference to FIG. 1.

FIG. 1 is a side view showing a mechanical configuration of a keyboard apparatus according to an embodiment of the present invention. As shown in FIG. 1, the keyboard apparatus 1 according to the first embodiment of the present invention includes a plurality of keys 110 (in this example, 88 keys) and an action mechanism corresponding to each of the keys 110. The action mechanism includes a support assembly 20, a hammer shank 310, a hammer 320, and a hammer stopper 410. It should be noted that although FIG. 1 shows a case where a key 110 is a white key, the same applies to a case where the key 110 is a black key. Further, in the following description, the terms employed to express orientations, such as "closer to the player", "farther away from the player", "above", "below", and "laterally", are defined as orientations as seen by the player facing the keyboard apparatus. For example, in the example shown in FIG. 1, the support assembly 20 is disposed closer to the player than the hammer 320 and disposed above the key 110. The term "laterally" corresponds to the direction in which the keys 110 are arranged.

The key 110 is rotatably supported by a balance rail 910. The key 110 rotates within a range from a rest position to an end position shown in FIG. 1. The key 110 includes a capstan screw 120. The support assembly 20 is rotatably connected to a support flange 290 and resting on the capstan screw 120. The support flange 290 is fixed to a support rail 920. A configuration of the support assembly 20 will be described in detail later. It should be noted that the support flange 290 and the support rail 920 are an example of a frame. The support assembly 20 rotates with respect to the frame. The frame may be formed by a plurality of members such as the support flange 290 and the support rail 920 or may be formed by a single member. The frame may be a rail-shaped member, such as the support rail 920, whose longer sides extend in the direction in which the keys 110 are arranged. The frame may be a member, such as a support flange 290, which is independent for each key 110.

The hammer shank 310 is rotatably connected to a shank flange 390. The hammer shank 310 includes a hammer roller 315. The hammer shank 310 is mounted over the support assembly 20 via the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940 and disposed in such a position as to regulate the rotation of the hammer shank 310.

A sensor 510 is a sensor for measuring the position and moving speed (i.e. the speed of the hammer shank 310 about to collide with the hammer stopper 410) of the hammer shank 310. The sensor 510 is fixed to a sensor rail 950. In this example, the sensor 510 is a photointerrupter. An output value from the sensor 510 changes according to the amount by which the optical axis of the photointerrupter is shielded by a shielding plate 520 fixed to the hammer shank 310. The position and moving speed of the hammer shank 310 can be measured on the basis of this output value. It should be noted that a sensor for measuring the operational state of the key 110 may be provided in place of or together with the sensor 510.

The support rail 920, the shank rail 930, the hammer stopper rail 940, and the sensor rail 950 are supported by a bracket 900.

[Configuration of Support Assembly 20]

Figure 2:
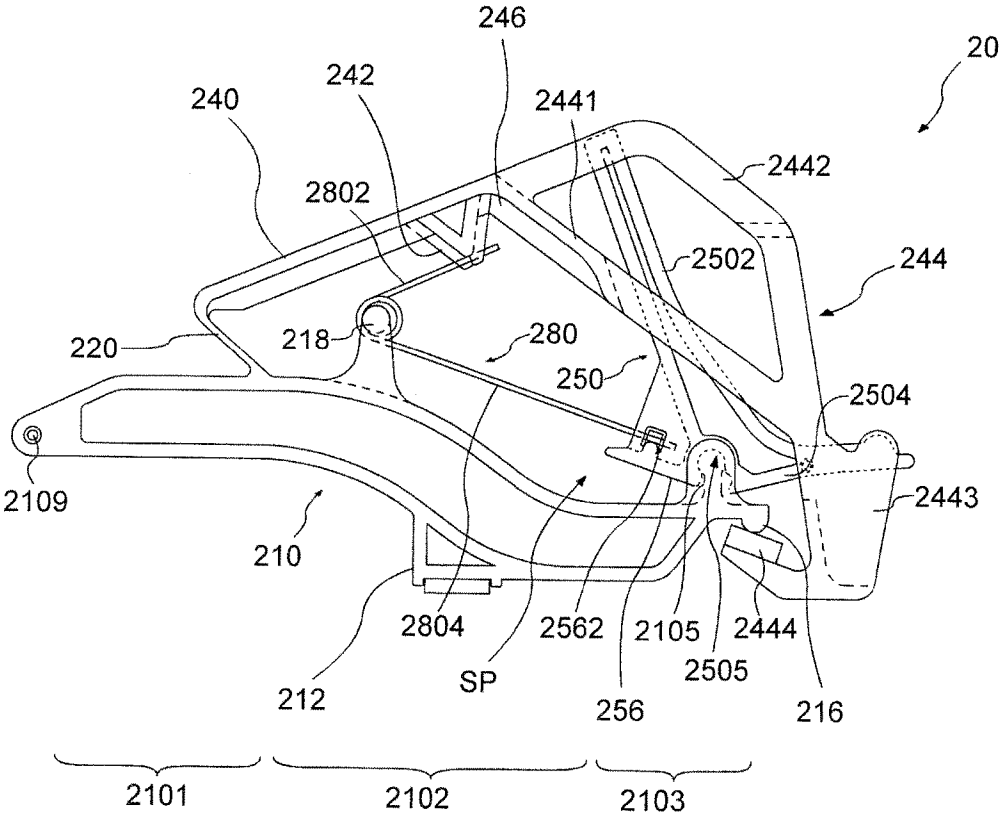
FIG. 2 is a side view showing a configuration of a support assembly according to an embodiment of the present invention.

FIG. 2 is a side view showing a configuration of a support assembly according to an embodiment of the present invention. The support assembly 20 includes a support 210, a repetition lever 240, a jack 250, and a torsion coil spring 280. The support 210 and the repetition lever 240 are coupled to each other via a flexible portion 220. The repetition lever 240 is supported by the flexible portion 220 to be rotatable with respect to the support 210. The support assembly 20 is a resin structure manufactured by injection molding or the like, excluding the torsion coil spring 280 and a cushion material (such as an unwoven fabric or an elastic body) provided in a part of the support assembly 20 that collides with the other member). In this example, the support 210 and the repetition lever 240 are integrally formed. It should be noted that the support 210 and the repetition lever 240 may be formed as individual parts and these members may be bonded or joined to each other.

A through hole 2109 is formed at one end side of the support 210. A jack supporting portion 2105 is formed at another end side of the support 210. The support 210 includes a support heal 212 and a spring supporting portion 218. The support heal 212 and the spring supporting portion 218 are located between the through hole 2109 and the jack supporting portion 2105. The support heal 212 projects downward. The spring supporting portion 218 projects upward. A shaft is passed through the through hole 2109. The shaft is supported by the support flange 290. This allows the support 210 to be disposed to be rotatable with respect to the support flange 290 and the support rail 920. The support heel 212 has a lower surface that contacts with the aforementioned capstan screw 120. The spring supporting portion 218 supports the torsion coil spring 280. The jack supporting portion 2105 rotatably supports the jack 250.

There is a space SP between the through hole 2109 and the jack supporting portion 2105. The space SP is located closer to the jack supporting portion 2105 than the support heel 212. For convenience of explanation, the support 210 is divided into regions, namely a first main body portion 2101, a bent portion 2102, and a second main body portion 2103, starting from the through hole 2109 side. In this case, the bent portion 2102, via which the first main body portion 2101 and the second main body portion 2103 are coupled to each other, causes the second main body portion 2103 to be disposed closer to the key 110 (in a lower position) than the first main body portion 2101. The jack supporting portion 2105 projects upward from the second main body portion 2103. According to this division, the space SP corresponds to a region above the second main body portion 2103 that is interposed between the bent portion 2102 and the jack supporting portion 2105. Further, a stopper 216 is coupled to an end portion of the support 210 (end portion of the second main body portion 2103).

A spring contact portion 242 and an extension portion 244 (first extension portion) are coupled to the repetition lever. The spring contact portion 242 and the extension portion 244 extend from the repetition lever 240 toward the support 210. The spring contact portion 242 contacts with a first arm 2802 of the torsion coil spring 280. The repetition lever 240 and the extension portion 244 include two plate-shaped members that hold the jack 250 from the sides of both side surfaces. In this example, the extension portion 244 and the jack 250 are in slide contact with each other in at least part of the space interposed between these two plate-shaped members.

The extension portion 244 includes an inner portion 2441, an outer portion 2442, a coupling portion 2443, and a stopper contact portion 2444. The inner portion 2441 is coupled to the repetition lever 240 at a region farther away from the player (i.e. closer to the flexible portion 220) than a large jack 2502. A rib 246 is provided in the part where the repetition lever 240 and the inner portion 2441 are coupled to each other. The inner portion 2441 crosses the large jack 2502 with the large jack 2502 inserted therein and extends to a side closer to the player than the large jack 2502 (i.e. an opposite side of the flexible portion 220 with respect to the large jack 2502). That is, it can also be said that the extension portion 244 crosses the jack 250. Either/both the inner portion 2441 or/and the large jack 2502 may be provided with a projecting portion(s) that reduce(s) the area of contact between the inner portion 2441 and the large jack 2502. The projecting portion(s) may take the form of a dot(s) or a line(s).

The outer portion 2442 is coupled to the repetition lever 240 at a region closer to the player than the jack 250 (large jack 2502) (i.e. an opposite side of the flexible portion 220 with respect to the repetition lever 240). The inner portion 2441 is coupled to the outer portion 2442 at the coupling portion 2443. The coupling portion 2443 holds a small jack 2504 from the sides of both side surfaces. Note here that either/both the coupling portion 2443 or/and the small jack 2504 may be provided with a projecting portion(s) that reduce(s) the area of contact between the coupling portion 2443 and the small jack 2504. The projecting portion(s) may take the form of a dot(s) or a line(s).

The stopper contact portion 2444 is coupled to the coupling portion 2443 and contacts with the stopper 216 from below the stopper 216. That is, the stopper 216 regulates the range of (upward) rotation of the repetition lever 240 in the direction that the repetition lever 240 and the support 210 spread. In other words, the extension portion 244 is connected to the repetition lever 240 at a region closer to the jack 250 than the center of rotation of the repetition lever 240, and contacts with the stopper 216 from below the stopper 216. Note here that the stopper 216 is connected to the support 210 below the center of rotation of the jack 250.

The jack 250 includes the large jack 2502, the small jack 2504, and a projecting portion 256. The jack 250 is disposed to be rotatable with respect to the support 210. A support connecting portion 2505 is formed between the large jack 2502 and the small jack 2504. The support connecting portion 2505 is rotatably supported by the jack supporting portion 2105. The support connecting portion 2505 has a shape that surrounds a part of the jack supporting portion 2105, and regulates the range of rotation of the jack 250. Further, the shape of the support connecting portion 2505 and the elastic deformation of a material of the support connecting portion 2505 allow the jack 250 to be fitted from above the jack supporting portion 2105. The projecting portion 256 projects from the large jack 2502 toward an opposite side of the small jack 2504 and rotates with the jack 250. The projecting portion 256 includes a spring contact portion 2562 on a side surface thereof. The spring contact portion 2562 contacts with a second arm 2804 of the torsion coil spring 280.

The torsion coil spring 280, supported on the spring supporting portion 218, has its first arm 2802 in contact with the spring contact portion 242 and its second arm 2804 in contact with the spring contact portion 2562. The first arm 2802 functions as an elastic body that applies a rotating force to the repetition lever 240 via the spring contact portion 242 so that the player's side of the repetition lever 240 moves upward (in a direction away from the support 210). The second arm 2804 functions as an elastic body that applies a rotating force to the jack 250 via the spring contact portion 2562 so that the projecting portion 256 moves downward (in a direction toward the support 210). The foregoing has described the configuration of the support assembly 20.

[Movements of Support Assembly 20]

The following describes the motion of the support assembly 20 in a case where the key 110 is depressed into the end position out of the state of being in the rest position (FIG. 1).

Figure 3:
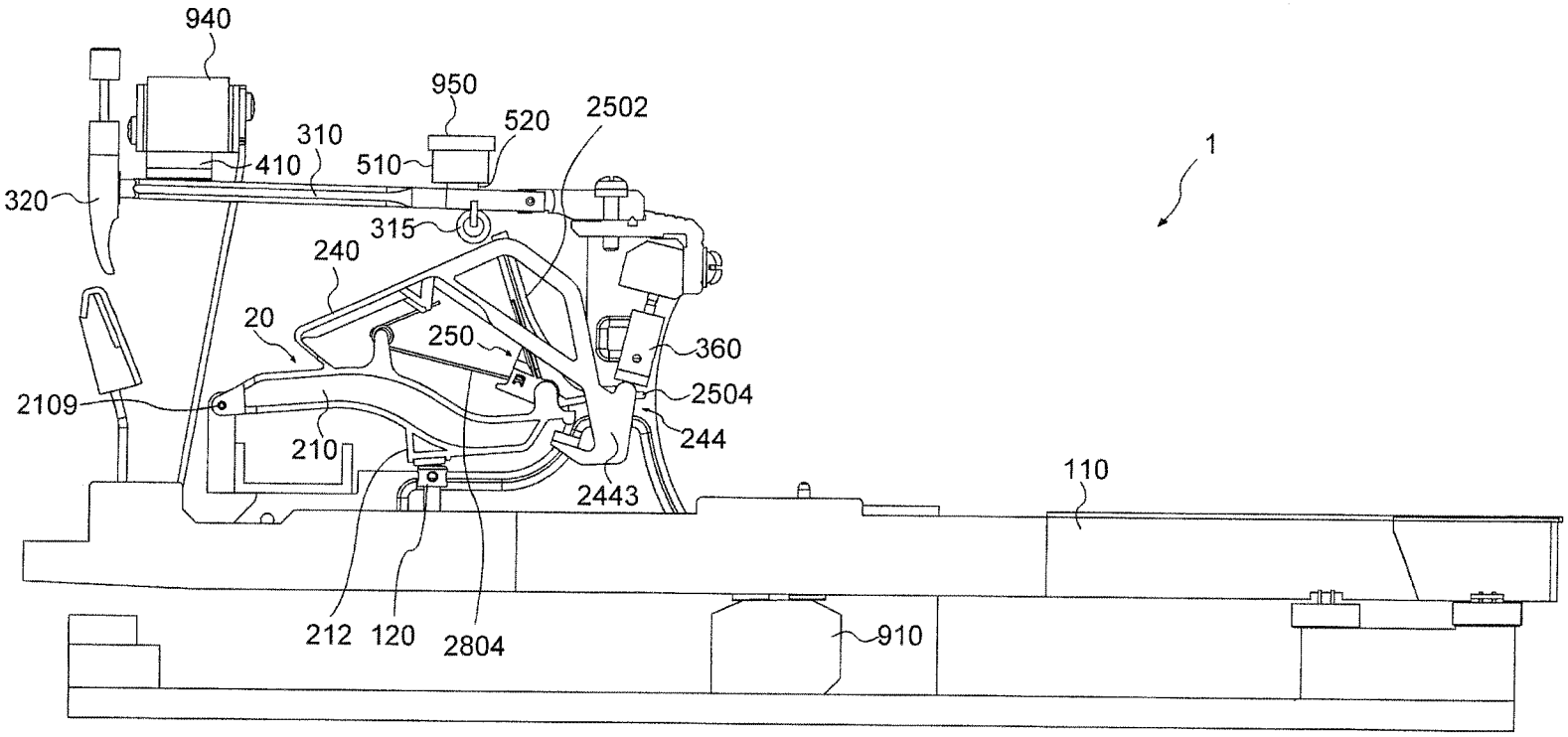
FIG. 3 is a side view for explaining the motion of a support assembly according to an embodiment of the present invention.

FIG. 3 is a side view for explaining the motion of a support assembly according to an embodiment of the present invention. When the key 110 is depressed into the end position, the capstan screw 120 presses up the support heal 212 to cause the support 210 to rotate on the shaft passed through the through hole 2109. When the support 210 rotates to move upward, the large jack 2502 presses up the hammer roller 315, so that the hammer shank 310 collides with the hammer stopper 410. It should be noted that, in the case of a conventional grand piano, this collision is equivalent to the striking of a string by a hammer.

Immediately before this collision, the upward movement of the small jack 2504 is regulated by the regulating button 360, and furthermore, the support 210 (jack supporting portion 2105) rises. This causes the large jack 2502 to rotate out of the hammer roller 315. At this point in time, the regulating button 360 also regulates the upward movement of the coupling portion 2443. In this example, the regulating button 360 also has a function of a repetition regulating screw in an action mechanism of a conventional grand piano.

This regulates the upward movement of the repetition lever 240 so that the repetition lever 240 rotates toward the support 210. These movements achieve a double escapement mechanism. FIG. 3 shows this state. It should be noted that returning the key 110 to the rest position causes the hammer roller 315 to be supported by the repetition lever 240, so that the large jack 2502 returns to a lower position of the hammer roller 315.

As described above, the keyboard apparatus 1 according to the first embodiment of the present invention makes it possible to make sure that the support assembly makes movements equivalents to conventional ones and to reduce the number of parts that constitute the support assembly. Therefore, double escapement is achieved in a configuration that is simpler than a support assembly that is used in a conventional grand piano. This makes it possible to curb the influence on the feeling of touch and reduce manufacturing costs.

Further, the extension portion 244 contacts with the stopper from below the stopper and regulates the rotation of the repetition lever 240. A conventionally-required repetition lever button that regulates the rotation of the repetition lever can be omitted by providing the extension portion 244 closer to the jack 250 than the center of rotation of the repetition lever 240. Thus, allowing the repetition lever 240 to be supported by the flexible portion 220. Structuring the repetition lever 240 to be supported by the flexible portion 220 makes it possible to make the number of parts smaller than before.

Further, a space-saving support assembly can be achieved since the extension portion 244 extends from the repetition lever 240 toward the support 210 and is locked by the stopper 216 connected to the support 210.

Further, since the jack 250 contacts slidably with the extension portion 244 at either/both the crossing between the inner portion 2441 and the large jack 2502 or/and the crossing between the coupling portion 2443 and the small jack 2504, the jack 250 also functions as a guide for the repetition lever 240 (and the extension portion 244). Therefore, even if the likelihood of yawing and rolling of the repetition lever 240 is high due to the connection of the repetition lever 240 to the support 210 via the flexible portion 220, the occurrence of these phenomena can be reduced. This allows the repetition lever 240 to rotate along the surface along which the jack 250 rotates. Further, since the jack 250 rotates along the surface along which the support 210 rotates, the repetition lever 240 can rotate along the surface along which the support 210 rotates.

Further, the connection of the stopper 216 to the support 210 below the center of rotation of the jack 250 makes it possible to provide the stopper 216 without greatly changing the shape of the support 210.

[Sound Generating Mechanism of Keyboard Apparatus 1]

The keyboard apparatus 1, which is an example of application of an electronic piano as mentioned above, measures the operation of a key 110 with a sensor 510 and outputs a sound corresponding to a measurement result.

Figure 4:
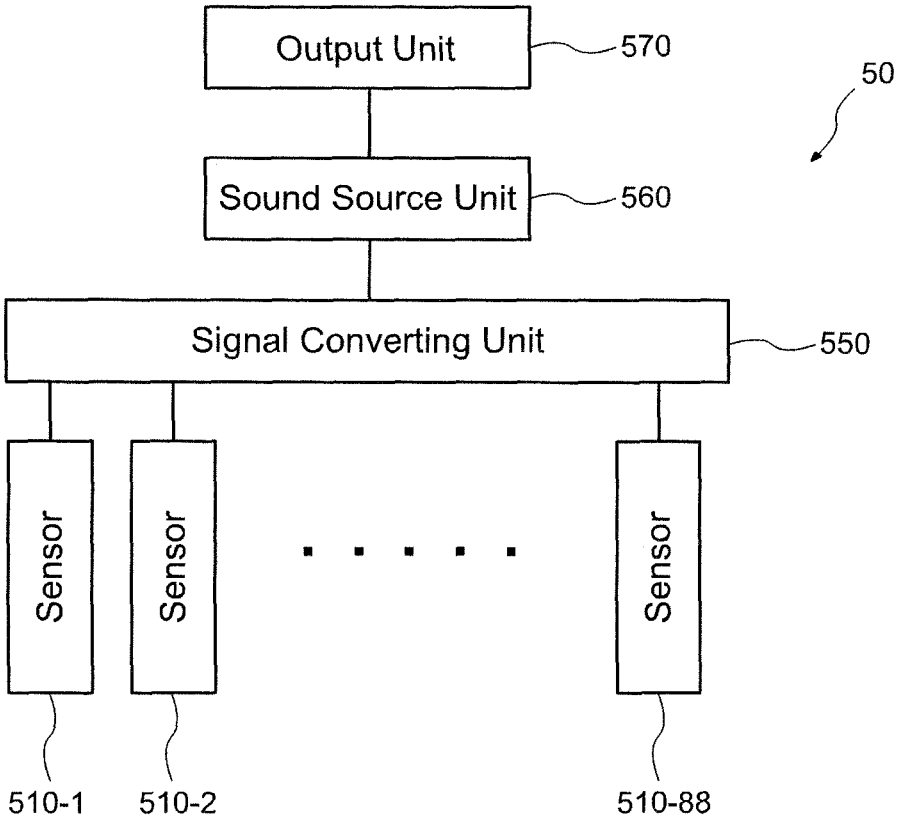
FIG. 4 is a block diagram showing a configuration of a sound generating mechanism of a keyboard apparatus according to an embodiment of the present invention.

FIG. 4 is a block diagram showing a configuration of a sound generating mechanism of a keyboard apparatus according to an embodiment of the present invention. The keyboard apparatus 1 has a sound generating mechanism 50 including sensors 510 (sensors 510-1, 510-2, . . . 510-88, which correspond to the 88 keys 110), a signal conversion unit 550, a sound source unit 560, and an output unit 570. The signal conversion unit 550 acquires an electric signal outputted from a sensor 510, generates an actuating signal corresponding to the operational state of each key 110, and outputs the actuating signal. In this example, the actuating signal is an MIDI-format signal. Therefore, the signal conversion unit 550 outputs a note-on in accordance with the timing of collision of the hammer shank 310 with the hammer stopper 410 through a key-pressing operation. At this point in time, a key number indicating which of the 88 keys 110 has been operated and a velocity corresponding to the speed of the hammer shank 310 about to collide with the hammer stopper 410 are outputted in association with the note-on. Meanwhile, once a key-releasing operation is performed, the signal conversion unit 550 outputs a key number and a note-off in association with each other in accordance with the timing of stoppage of vibration of the string by a damper in the case of a grand piano. A signal corresponding to another operation such as pedaling may be inputted to the signal conversion unit 550 and reflected in the actuating signal. The sound source unit 560 generates a sound signal in accordance with the actuating signal outputted from the signal conversion unit 550. The output unit 570 is a speaker or terminal that outputs the sound signal generated by the sound source unit 560.

<Modification of First Embodiment>

Figure 5:
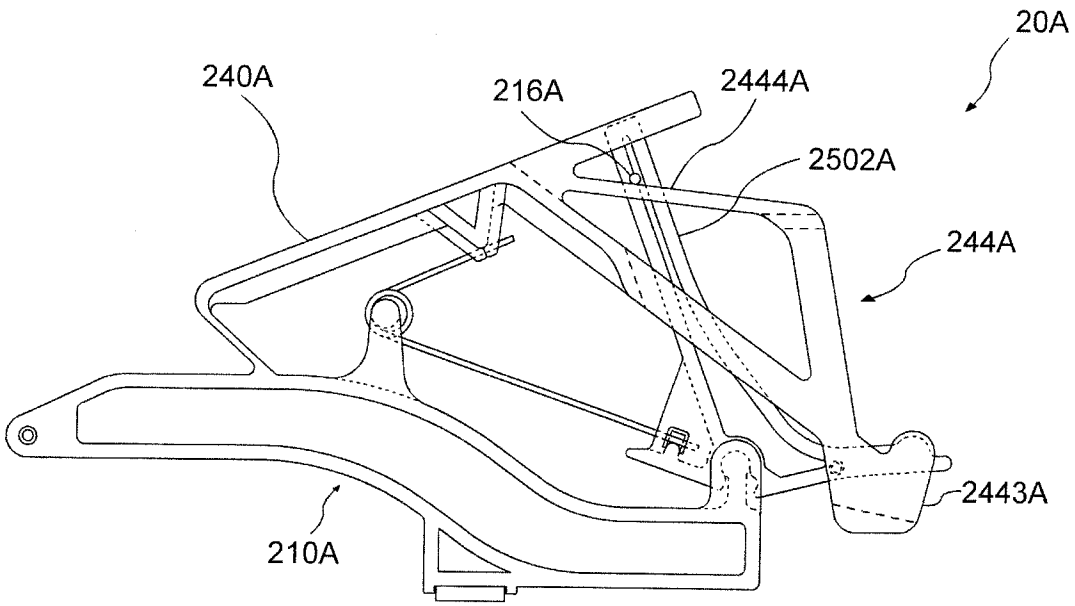
FIG. 5 is a side view showing a configuration of a support assembly according to a modification of an embodiment of the present invention.

FIG. 5 is a side view showing a configuration of a support assembly according to a modification of an embodiment of the present invention. A support assembly 20A shown in FIG. 5 is similar to the support assembly 20 shown in FIG. 2. However, the support assembly 20A differs from the support assembly 20 in that, instead of including the stopper 216 and the stopper contact portion 2444, the support assembly 20A includes a pin shaped stopper 216A provided in a large jack 2502A and includes a stopper contact portion 2444A. The stopper 216A is provided in such a position as to be able to lock the stopper contact portion 2444A and regulates the range of rotation of a repetition lever 240A. In the state shown in FIG. 5, the upward rotation of the repetition lever 240A is regulated by the stopper contact portion 2444A contacting with the stopper 216A from below the stopper 216A. As described above, a stopper that regulates the range of rotation of the repetition lever 240A may be provided in a part other than a support 210A.

<Second Embodiment>

[Configuration of Keyboard Apparatus 1 B]

As with the keyboard apparatus 1 according to the first embodiment, a keyboard apparatus 1B according to a second embodiment of the present invention is an example in which an example of a support assembly according to the present invention is applied to an electronic piano. The keyboard apparatus 1B is similar to the keyboard apparatus 1 but differs from the keyboard apparatus 1 in terms of the support assembly and the supporting structure of the support assembly. Further, the keyboard apparatus 1B differs from the keyboard apparatus 1 in terms of how the upward rotation of the repetition lever of the support assembly is regulated. The following description focuses attention on these differences and omits the common parts.

Figure 6:
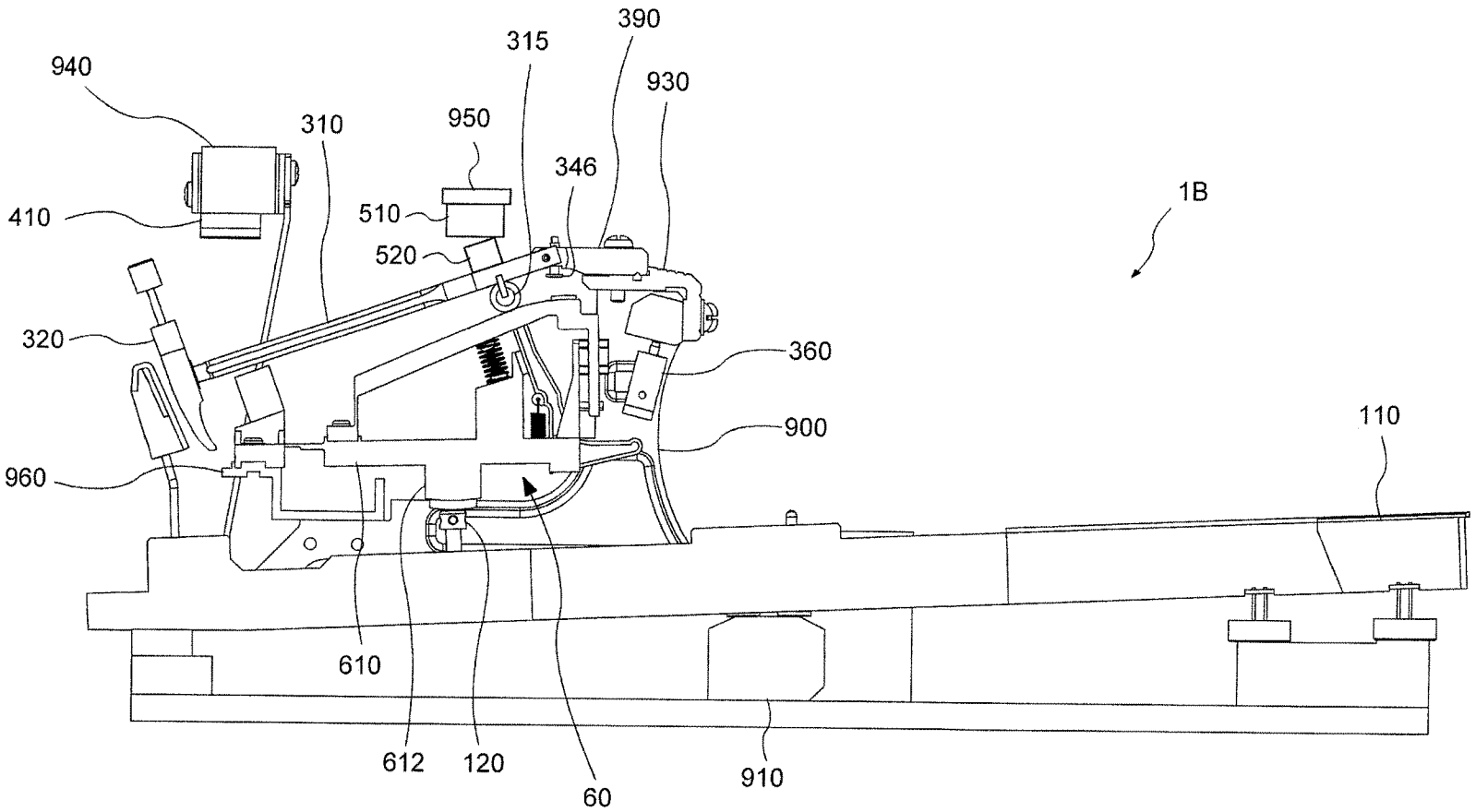
FIG. 6 is a side view showing a configuration of a keyboard apparatus according to an embodiment of the present invention.

FIG. 6 is a side view showing a configuration of a keyboard apparatus according to an embodiment of the present invention. A support assembly 60 is fixed to a support rail 960. The support rail 960 is supported by the bracket 900. The support assembly 20 according to the first embodiment is rotatably supported by the shaft supported by the support flange 290 passing through the through hole 2109. Meanwhile, the support assembly 60 is the same as the support assembly 20 in that a support 610 is rotatably supported by the support rail 960 but, as will be described later, is different from the support assembly 20 in terms of how the support 610 is supported. A repetition regulating screw 346 regulates the upward rotation of the support assembly 60 (toward the hammer shank 330). It should be noted that the support rail 960 is an example of a frame. The support assembly 60 rotates with respect to the frame. The frame may be formed by a single member such as the support rail 960 or may be formed by a plurality of members. The frame may be a rail-shaped member, such as the support rail 960, whose longer sides extend in the direction in which the keys 110 are arranged. The frame may be a member that is independent for each key 110.

[Configuration of Support Assembly 60]

Figure 7:
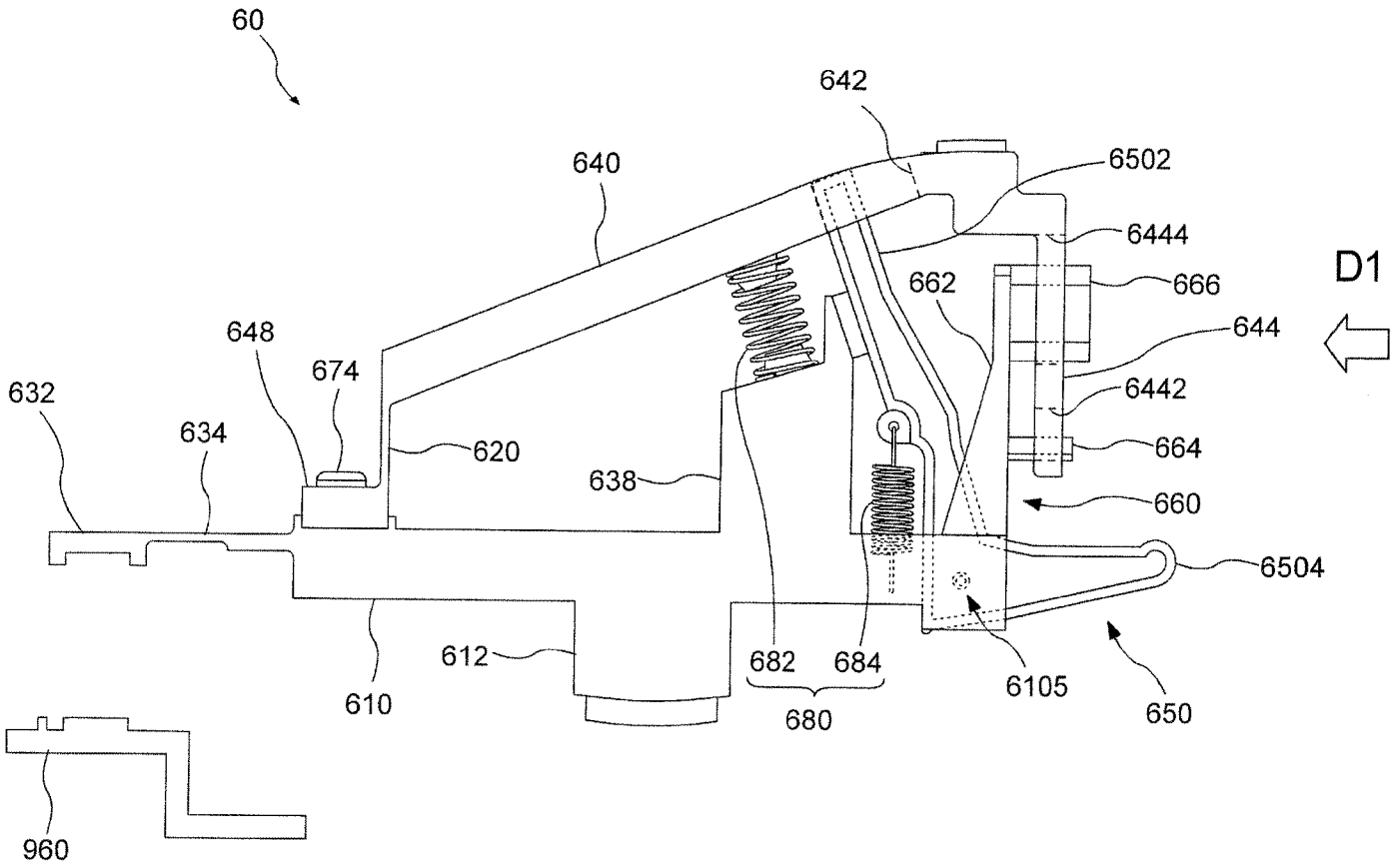
FIG. 7 is a side view showing a configuration of a support assembly according to an embodiment of the present invention.

FIG. 7 is a side view showing a configuration of a support assembly according to an embodiment of the present invention. Further, the support assembly 60 of the keyboard apparatus 1B includes the support 610, a repetition lever 640, a jack 650, a movement regulating portion 660, and a coil spring 680. The support assembly 60 is a resin structure manufactured by injection molding or the like, excluding the torsion coil spring 280 and a cushion material (such as an unwoven fabric or an elastic body) provided in a part of the support assembly 60 that collides with the other member).

The support 610 is rotatably supported by the support rail 960. The repetition lever 640 is rotatably supported by the support 610. The jack 650 is rotatably disposed to the support 610. The jack 650 includes a large jack 6502 and a small jack 6504. The large jack 6502 is disposed to be able to pass through a slit 642 provided in the repetition lever 640. The small jack 6504 extends from the support 610 toward a side closer the player. The movement regulating portion 660 is disposed to the support 610 at a region closer to the repetition lever 640 than the support 610.

Further, the support 610 includes a support heel 612, a frame fixing portion 632, a flexible portion 634, and a base 638. The frame fixing portion 632 fixes the support 610 to the support rail 960. The flexible portion 634 is provided between the support 610 and the frame fixing portion 632 of each support assembly 60 and has flexibility (elasticity). The flexible portion 634 is formed integrally with the support 610 and the frame fixing portion 632. The flexible portion 634 is thinner in thickness than at least the support 610 in the direction of rotation of the support assembly 60 or the through-thickness direction of the flexible portion 634. It should be noted that although FIG. 7 illustrates a structure in which the support 610, the frame fixing portion 632, and the flexible portion 634 are integrally formed, this structure is not intended to be limitative. For example, the flexible portion 634 may be fixed to both/either the support 610 and/or the frame fixing portion 632, for example, with a fixing piece, with an adhesive, or by welding. Note here that the flexible portion 634 serves as the center of rotation of the support assembly 60.

The base 638 is connected to the support 610 at a region closer to the repetition lever 640 than the support 610. A coil spring 682 that acts on the base 638 and the repetition lever 640 is provided on an upper surface of the base 638 (which faces the repetition lever 640). The coil spring 682 is a compressed spring that functions as an elastic body which applies a rotating force to the repetition lever 640 by acting on the base 638 and the repetition lever 640 in such a direction that the base 638 and the repetition lever 640 move away from each other.

The repetition lever 640 includes a flexible portion 620, the slit 642, an extension portion 644, and a support fixing portion 648.

The flexible portion 620 extends from the repetition lever 640 to the support 610 side, and is coupled to the support fixing portion 648. That is, the flexible portion 620 is provided between the repetition lever 640 and the support fixing portion 648. The flexible portion 620 is formed integrally with the support fixing portion 648 and the repetition lever 640. Since the flexible portion 620 is thinner than the repetition lever 640, the flexible portion 620 has flexibility (elasticity). This allows the repetition lever 640 to rotate on the flexible portion 620.

The slit 642 is located in a part of the repetition lever 640 that is closer to the player than the flexible portion 620, which serves as the center of rotation of the repetition lever 640. The slit 642 is provided in such a position that the large jack 6502 can pass through the slit 642. The extension portion 644 is located closer to the jack 650 than the flexible portion 620, which serves the center of rotation of the repetition lever 640. The extension portion 644 is coupled to the repetition lever 640 at a region closer to the support 610 than the repetition lever 640. The extension portion 644 includes slits 6442 and 6444. The support fixing portion 648 is fixed to the support 610 by a fixing piece 674.

It should be noted that although FIG. 7 illustrates a structure in which the repetition lever 640, the flexible portion 620, and the support fixing portion 648 are integrally formed, this structure is not intended to be limitative. For example, the flexible portion 620 may be fixed to both/either the repetition lever 640 and/or the support fixing portion 648, for example, with a fixing piece, with an adhesive, or by welding.

The jack 650 is rotatably disposed to the support 610 at a jack supporting portion 6105 between the large jack 6502 and the small jack 6504. A coil spring 684 that acts on the large jack 6502 and the support 610 is provided at a part of the large jack 6502. The coil spring 684 is a tension spring that functions as an elastic body which applies a rotating force to the jack 650 by acting on the large jack 6502 and the support 610 in such a direction that the large jack 6502 moves toward the base 638.

The movement regulating portion 660 is provided on an opposite side of the flexible portion 634 with respect to the flexible portion 620. Further, the movement regulating portion 660 includes an extension portion 662 (second extension portion), a stopper 664, and a guide 666. The extension portion 662 is disposed to the support 610 at a region closer to the repetition lever 640 than the support 610. The stopper 664 and the guide 666 are disposed on the extension portion 662 and each extend from the extension portion 662 toward the side closer to the player. In other words, it can also be said that the stopper 664 and the guide 666 are projecting portions that project from the extension portion 662 toward the side closer to the player. The stopper 664 passes through the slit 6442 provided in the extension portion 644 (first extension portion). The guide 666 passes through the slit 6444 provided in the extension portion 644. It should be noted that the slits 6442 and 6444 need only be shaped so that the stopper 664 and the guide 666 can be locked in the slits 6442 and 6444, respectively. For example, the slits 6442 and 6444 may be shaped to be provided with grooves in which the stopper 664 and the guide 666 can be locked, respectively. The slits 6442 and 6444 can also be said to be locking portions.

Figure 8A:
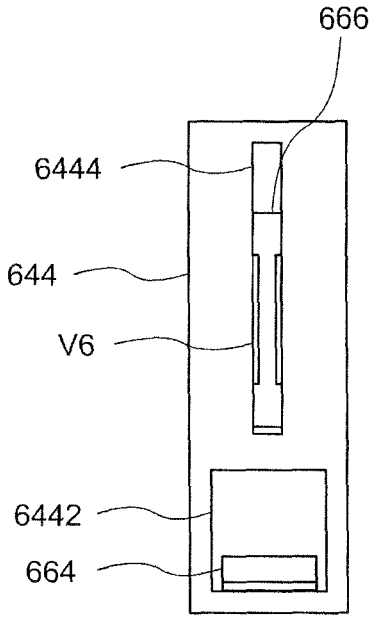
FIG. 8A is a side view showing a configuration of a stopper and a guide of a support assembly according to an embodiment of the present invention.
Figure 8B:
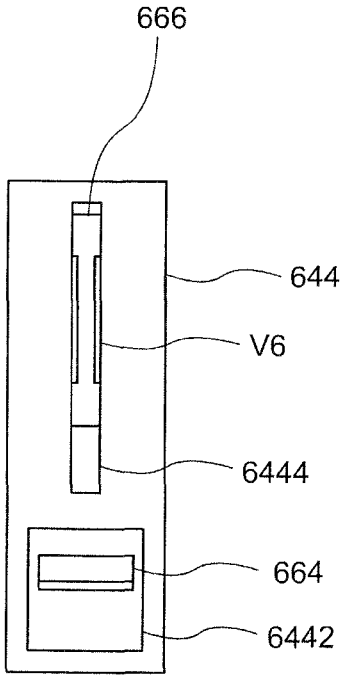
FIG. 8B is a side view showing a configuration of a stopper and a guide of a support assembly according to an embodiment of the present invention.

FIG. 8A and FIG. 8B are side views showing a configuration of a stopper and a guide of a support assembly according to an embodiment of the present invention.

The side views shown in FIG. 8A and FIG. 8B are side views as seen from direction D1 in FIG. 7 and show only the extension portion 644, the stopper 664, and the guide 666. Further, FIG. 8A and FIG. 8B are side views of the rest position and the end position, respectively. The stopper 664 has its longer sides extending in a direction crossing the direction of rotation of the repetition lever 640 and the extension portion 644. Further, the guide 666 and the slit 6444 have their longer sides extending in the direction of rotation of the repetition lever 640 and the extension portion 644. Since the guide 666 has groove portions V6 facing inner walls of the slit 6444, the area of slide contact between the guide 666 and the slit 6444 is small. Grease may be applied to the groove portions V6.

Note here that, in the state of the rest position shown in FIG. 7 and FIG. 8A, the extension portion 644 is in contact with the stopper 664 in the slit 6442 from the stopper 664 side of the support 610 (below). In other words, the extension portion 644 is in contact with the movement regulating portion 660 from below the movement regulating portion 660. That is, the stopper 664 or the movement regulating portion 660 regulates the (upward) rotation of the repetition lever 640 and the extension portion 644 toward the hammer shank 310. A cushion material (such as an unwoven fabric or an elastic body) for reducing noise may be provided between the extension portion 644 and the stopper 664. The cushion material is generated by the extension portion 644 and the stopper 664 contacting with each other.

Further, the extension portion 644 is in contact laterally with the guide 666 in the slit 6444. Note here that the term "laterally" refers to the direction in which support assemblies 60 are adjacent to each other or the direction in which the support rail 960 extends. In other words, the extension portion 644 is in contact laterally with the movement regulating portion 660. That is, the guide 666 or the movement regulating portion 660 reduces the yawing and rolling of the repetition lever 640. Grease may be applied between the extension portion 644 and the guide 666 in order to allow the extension portion 644 and the guide 666 to smoothly slide over each other.

It should be noted that although FIG. 7, FIG. 8A and FIG. 8B illustrate a configuration in which the extension portion 644 connected to the repetition lever 640 is provided with slits and the extension portion 662 connected to the support 610 is provided with projecting portions, this configuration is not intended to be limitative. For example, the extension portion 662 may be provided with slits, and the extension portion 644 may be provided with projecting portions passing through the slits, respectively.

As described above, the keyboard apparatus 1B according to the second embodiment of the present invention makes it possible to make sure that the support assembly makes movements equivalents to conventional ones and to reduce the number of parts that constitute the support assembly. This makes it possible to suppress a change in the feeling of touch at the time of operation of a key and reduce the manufacturing cost of the support assembly.

Further, since the guide 666 and the extension portion 644 are in contact slidably with each other, the guide 666 also functions as a guide portion of the repetition lever 640 coupled to the extension portion 644. This makes it possible to reduce the occurrence of yawing and rolling of the repetition lever 640.

[Movements of Support Assembly 60]

The following describes the motion of the support assembly 60 in a case where the key 110 is depressed into the end position out of the state of being in the rest position (FIG. 6).

Figure 9:
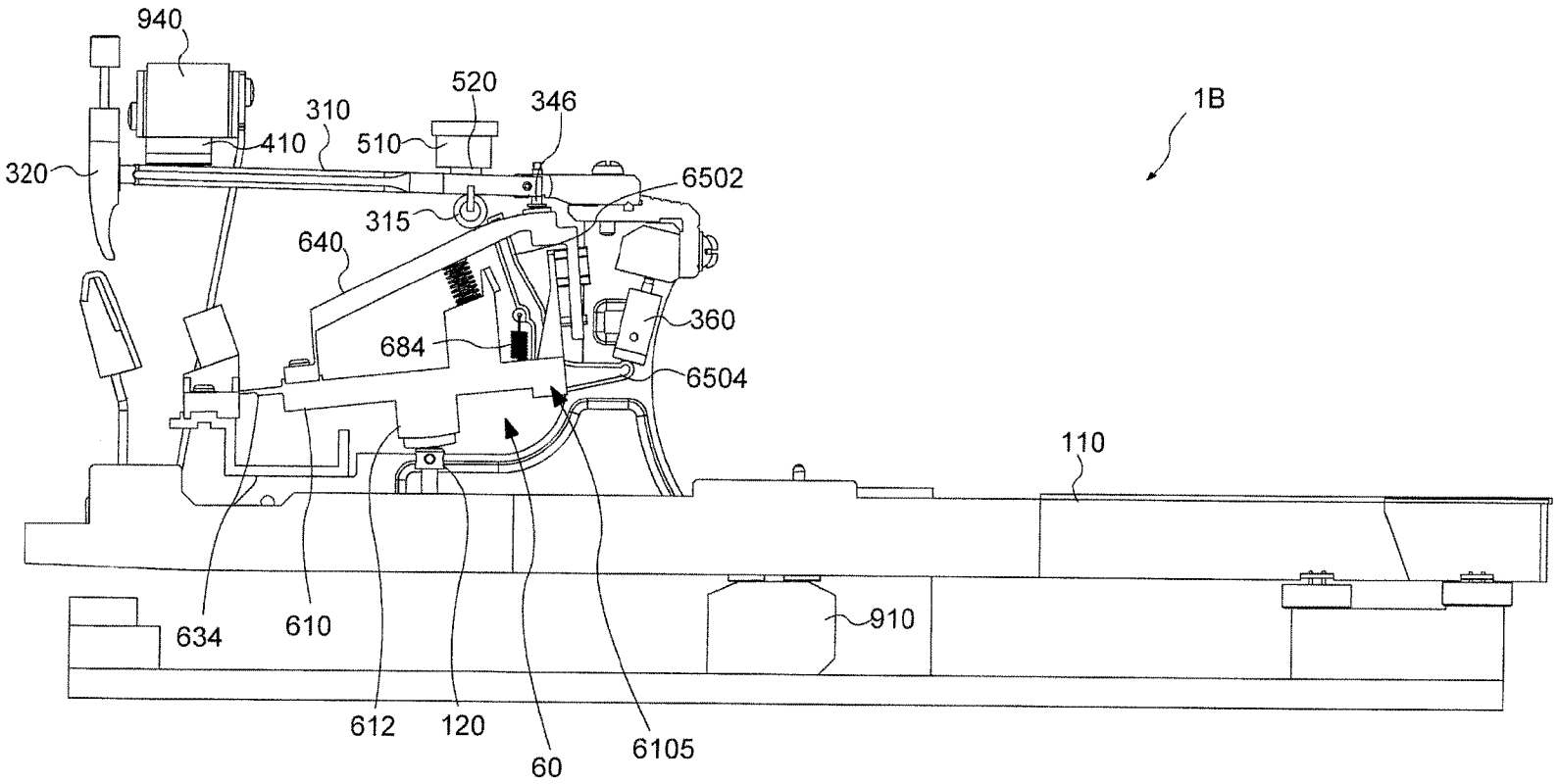
FIG. 9 is a side view for explaining the motion of a support assembly according to an embodiment of the present invention.

FIG. 9 is a side view for explaining the motion of a support assembly according to an embodiment of the present invention. When the key 110 is depressed into the end position, the capstan screw 120 presses up the support heal 612 to cause the support 610 to rotate on the axis of the flexible portion 634. When the support 610 rotates to move upward, the large jack 6502 presses up the hammer roller 315, so that the hammer shank 310 collides with the hammer stopper 410.

Immediately before this collision, the upward movement of the small jack 6504 is regulated by the regulating button 360, and furthermore, the support 610 (jack supporting portion 6105) rises. This causes the large jack 6502 to rotate out of the hammer roller 315. At this point in time, the repetition regulating screw 346 regulates the upward movement of the repetition lever 640. This regulates the upward movement of the repetition lever 640 so that the repetition lever 640 rotates toward the support 610. These movements achieve a double escapement mechanism. FIG. 9 shows this state. It should be noted that returning the key 110 to the rest position causes the hammer roller 315 to be supported by the repetition lever 640, so that the large jack 6502 returns to a lower position of the hammer roller 315.

Even such a support assembly 60 brings about the same effects as the support assembly 20. That is, double escapement is achieved in a configuration that is simpler than a support assembly that is used in a conventional grand piano. This makes it possible to curb the influence on the feeling of touch and reduce manufacturing costs.

Although each of the embodiments described above has illustrated a configuration in which the stopper is provided closer to the player than the large jack, the stopper may be provided between the large jack and a flexible portion serving as the center of rotation of the repetition lever.

Although each of the embodiments described above has illustrated a configuration in which the stopper is provided separately from the support, the stopper does not need to be provided separately from the support. An extension portion connected to the support may extend to a lower position of the support to from the repetition lever cause a part of the support to function as a stopper.

In each of the embodiments described above, the repetition lever is coupled to the support via a flexible portion. Meanwhile, an extension portion can be coupled to the repetition lever of a support assembly that is used in a conventional grand piano. Moreover, the extension portion can be brought into contact from below the stopper with a member (stopper) coupled to the support or the jack.

As described above by taking the first and second embodiments as examples, an embodiment of the present invention makes it possible to better suppress a change in the feeling of touch at the time of operation of a key and reduce the manufacturing cost of a support assembly than a keyboard apparatus of an acoustic piano.

Each of the embodiments described above has taken an electronic piano as an example of a keyboard apparatus to which a support assembly is applied. Meanwhile, the support assembly of the embodiment may can also be applied to a grand piano (acoustic piano). In this case, the sound generating mechanism corresponds to the hammers and the strings.

It should be noted that the present invention is not limited to the embodiments described above but may be appropriately modified without departing from the gist of the present invention.

REFERENCE SIGNS LIST

1: keyboard apparatus, 20, 60: support assembly, 50: sound generating mechanism, 110: key, 120: capstan screw, 210, 610: support, 212, 612: support heel, 216, 664: stopper, 218: spring supporting portion, 220: flexible portion, 240, 640: repetition lever, 242: spring contact portion, 244, 644, 646, 662: extension portion, 246: rib, 250, 650: jack, 256: projecting portion, 280: torsion coil spring, 290: support flange, 310: hammer shank, 315: hammer roller, 320: hammer, 360: regulating button, 390: shank flange, 410: hammer stopper, 510: sensor, 520: shielding plate, 550: signal conversion unit, 560: sound source unit, 570 output unit, 632: frame fixing portion, 634: flexible portion, 638: base, 642, 6442, 6444: slit, 648: support fixing portion, 660: movement regulating portion, 666: guide, 674: fixing piece, 680, 682, 684: coil spring, 900: bracket, 910: balance rail, 920: support rail, 930: shank rail, 940: hammer stopper rail, 950: sensor rail, 960: support rail, 2101: first main body portion, 2102: bent portion, 2103: second main body portion, 2105: jack supporting portion, 2109: through hole, 2441: inner portion, 2442: outer portion, 2443: coupling portion, 2444: stopper contact portion, 2502, 6502: large jack, 2504, 6504: small jack, 2505: support connecting portion, 2562: spring contact portion, 2802: first arm, 2804: second arm, 6105 jack supporting portion, SP: space

What is claimed is:

1. A support assembly comprising:

a support rotatable with respect to a frame;

a repetition lever rotatable with respect to the support; and a first extension portion disposed to the repetition lever on a jack side with respect to the center of rotation of the repetition lever, the first extension portion being in contact with a stopper from below the stopper such that the stopper regulates a range of upward rotation of the repetition lever, wherein the stopper rotates with the support.

2. The support assembly according to claim 1, further comprising a flexible portion supporting the repetition lever, the flexible portion being rotatable with respect to the support.

3. The support assembly according to claim 1, wherein the first extension portion extends from the repetition lever toward the support.

4. The support assembly according to claim 3, wherein the first extension portion crosses the jack.

5. The support assembly according to claim 4, wherein the stopper is disposed to the support below the center of rotation of the jack.

6. The support assembly according to claim 3, further comprising a second extension portion disposed to the support and the stopper and extending from the support toward the repetition lever.

7. The support assembly according to claim 6, wherein the first extension portion has a projecting portion, and the second extension portion has a locking portion in which the projecting portion is locked.

8. The support assembly according to claim 6, wherein the second extension portion has a projecting portion, and the first extension portion has a locking portion in which the projecting portion is locked.

9. The support assembly according to claim 2, wherein the first extension portion extends from the repetition lever toward the support.

10. The support assembly according to claim 9, wherein the first extension portion crosses the jack.

11. The support assembly according to claim 10, wherein the stopper is disposed to the support below the center of rotation of the jack.

12. The support assembly according to claim 11, further comprising a second extension portion disposed to the support and the stopper and extending from the support toward the repetition lever.

13. The support assembly according to claim 12, wherein the first extension portion has a projecting portion, and the second extension portion has a locking portion in which the projecting portion is locked.

14. The support assembly according to claim 6, wherein the second extension portion has a projecting portion, and the first extension portion has a locking portion in which the projecting portion is locked.

15. The support assembly according to claim 1, wherein the stopper is integral with the support.

16. A keyboard apparatus comprising:

a support assembly according to claim 1;

a key configured to rotate the support of the support assembly.

17. The keyboard apparatus according to claim 16, further comprising an output unit configured to output a sound signal generated according to a depression of the key.

18. The keyboard apparatus according to claim 17, wherein the output unit includes a speaker.

19. The keyboard apparatus according to claim 17, wherein the output unit includes a terminal.

20. The keyboard apparatus according to claim 16, further comprising a string generating a sound when hit by a hammer according to a depression of the key.

* * * * *